United States Patent [19]

Zownir et al.

[11] Patent Number: 4,620,370

[45] Date of Patent: Nov. 4, 1986

[54] CUE TIP TRIMMER

[76] Inventors: Michael Zownir, 418 Monroe St., NE., Albuquerque, N. Mex. 87108; Myron Zownir, 21-15 34th Ave., Long Island City, N.Y. 11106

[21] Appl. No.: 724,301

[22] Filed: Apr. 17, 1985

[51] Int. Cl.[4] ..... B27L 9/00

[52] U.S. Cl. ..... 30/494

[58] Field of Search ..... 30/494; 81/451

[56] References Cited

U.S. PATENT DOCUMENTS

| | | | |
|---|---|---|---|
| 89,624 | 5/1869 | Boyle | 30/494 |
| 94,317 | 8/1869 | Johnson et al. | 30/494 |
| 254,703 | 3/1882 | Ryan | 30/494 |
| 509,599 | 11/1893 | Higgs | 30/494 |
| 1,185,762 | 6/1916 | Bohlig | 30/494 |

*Primary Examiner*—Frederick R. Schmidt
*Assistant Examiner*—Joseph T. Zatarga
*Attorney, Agent, or Firm*—Harvey B. Jacobson

[57] ABSTRACT

A generally rectangular body is provided of substantially square cross-sectional shape and the body includes a central longitudinal threaded bore formed therethrough with one end of the bore provided with a smooth diametrically enlarged counter bore opening end wise outwardly of one end of the body. One side of the body is relieved to define a flat mounting surface disposed in a chord plane of the counter bore and mounts a blade member therefrom including an elongated beveled sharpened edge projecting slightly into the counter bore. An abutment screw is threadingly received within the bore and projects at least slightly into the counter bore and may be adjusted to adjustably limit the amount a cue stick mounted tip may be telescoped into the counter bore. The counter bore is of a size to snugly but loosely receive a newly mounted cue tip therein and the body may be rotated about the longitudinal axis of the threaded bore relative to an associated cue stick in order to trim the enlarged outer peripheral portion of a newly installed cue tip from the latter so as to provide the cue tip with a cylindrical outer surface co-extensive with adjacent cylindrical outer surfaces of the cue stick.

5 Claims, 6 Drawing Figures

FIG. 1
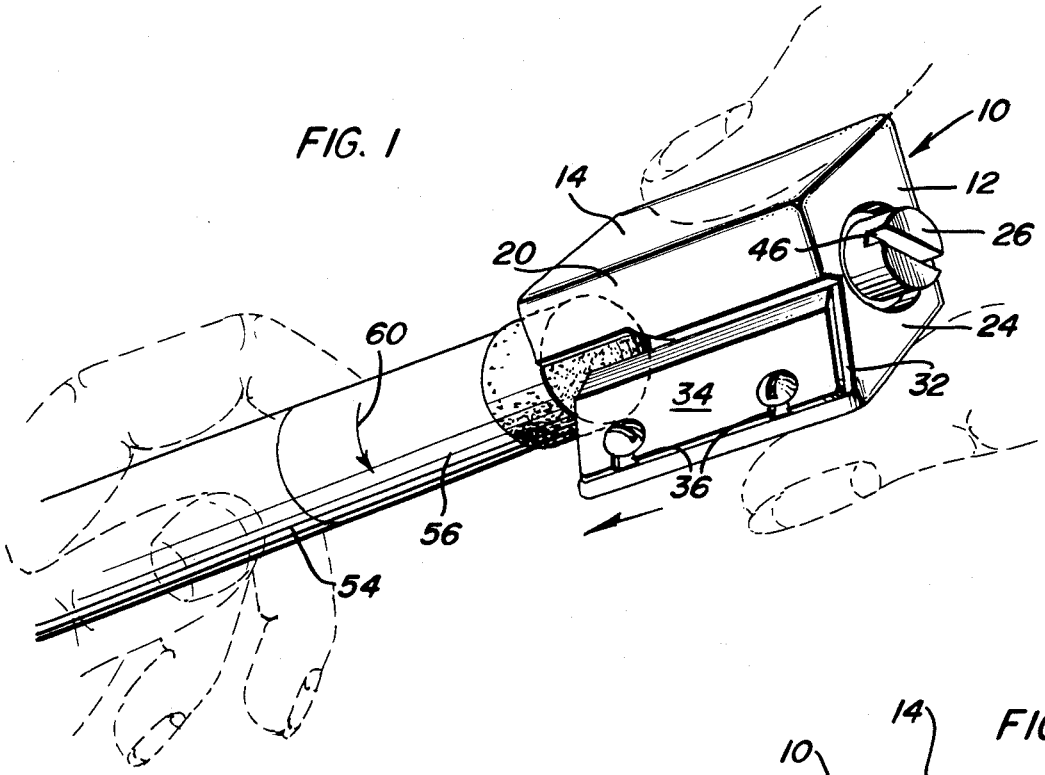
FIG. 3
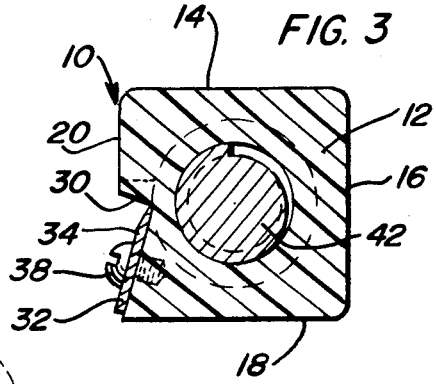
FIG. 2
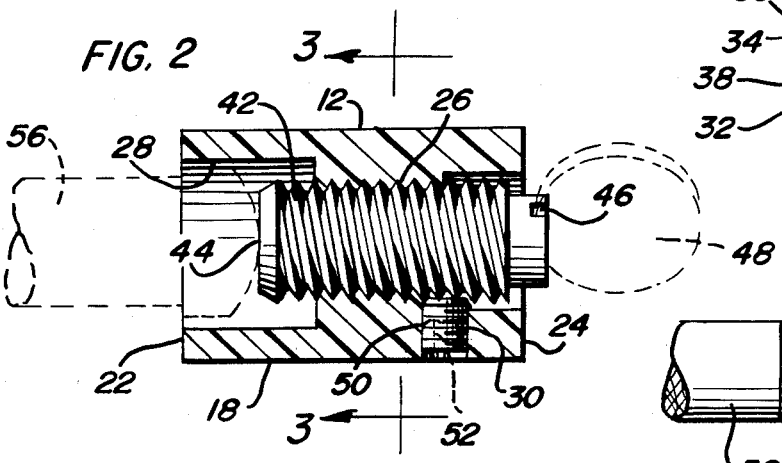
FIG. 5
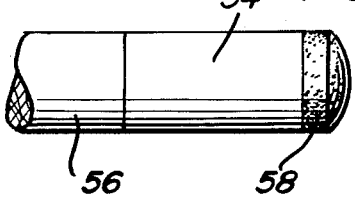
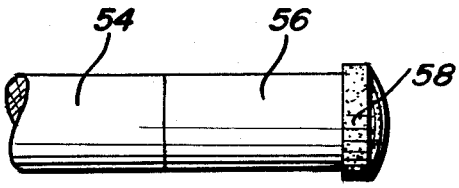
FIG. 4
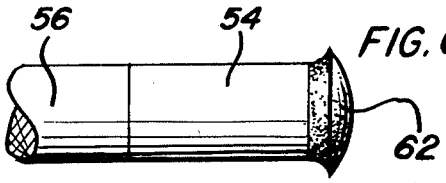
FIG. 6

CUE TIP TRIMMER

BACKGROUND OF THE INVENTION

1. Field of the Invention

This invention relates to an apparatus into which the tip equipped end of a cue stick may be inserted and relative to which the cue tip may be rotated about the longitudinal axis of the cue stick in order to trim those portions of a newly installed cue tip or a used cue tip which extend laterally outwardly beyond the ferrule end of the cue stick upon which the tip is mounted. The apparatus is adjustable whereby the cutting edge thereof is exposed only to the extent that the tip extends longitudinally of the associated cue stick, thereby preventing the cutting edge from also cutting the ferrule.

2. Description of Related Art

Various different forms of cue stick tip installing tools and trimmer devices heretofore have been provided for installing and trimming cue tips. However, none of these previously known devices are constructed to enable a cue tip trimming operation to be carried out with the ease in which the instant invention performs a cue tip trimming operation.

The trimmer of the instant invention includes basic structure not unlike that of a simple manual pencil sharpener provided for young school children to enable them to sharpen pencils. However, the cue tip trimmer includes certain modifications over a conventional pencil sharpener and one addition which particularly well adapts the trimmer of the instant invention for trimming cue stick tips as opposed to sharpening pencils.

SUMMARY OF THE INVENTION

The trimmer of the instant invention includes a body defining an outwardly opening bore and which mounts a cutting blade having a sharpened edge projecting into the bore along a short chord thereof. Further, abutment structure is provided for adjustable shifting relative to the inner end of the bore to thereby limit penetration of the tip equipped end of a cue stick into the bore.

The main object of this invention is to provide an apparatus by which a newly installed or used cue tip may have the outer periphery thereof trimmed so as to be co-extensive with the cylindrical outer surface of an adjacent ferrule carried by the associated cue stick.

A further object of this invention is to provide a cue stick tip trimmer which may be manually operated by even inexperienced persons in order to accurately trim a cue stick tip in an efficient manner.

Still another important object of this invention is to provide an apparatus for trimming the outer periphery of cue stick tips wherein the associated cue stick tip supporting ferrules are of different diameters.

A final object of this invention to be specifically enumerated herein is to provide a cue stick tip trimmer in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a perspective view of the trimmer of the instant invention in position preparatory to engagement of the trimmer with the tip mounted on the end of an associated cue stick;

FIG. 2 is an enlarged longitudinal sectional view of the trimmer with an associated cue stick and tip being illustrated in phantom lines as well as an attendant coin to adjust the trimmer abutment being illustrated in phantom lines;

FIG. 3 is a transverse sectional view taken substantially upon the plane indicated by the section line 3—3 of FIG. 2;

FIG. 4 is a fragmentary elevational view of the tip end of a cue stick having a newly installed tip mounted thereon;

FIG. 5 is a fragmentary elevational view similar to FIG. 4 but illustrating the tip in a trimmed condition; and FIG. 6 is an elevational view similar to FIGS. 4 and 5 and illustrating the condition of a used tip prior to trimming of the tip through the utilization of the trimmer of the instant invention.

DESCRIPTION OF THE PREFERRED EMBODIMENT

Referring now more specifically to the drawings the trimmer of the instant invention is referred to in general by the reference numeral 10 and includes a rectangular body 12 which is generally square in cross sectional shape. The body 12 includes 4 longitudinal sides 14, 16, 18 and 20 and a pair of opposite ends 22 and 24. The body 12 may be constructed of any suitable material such as a hard plastic or aluminum and has a central longitudinal threaded bore 26 formed therethrough. One end of the bore 26 includes a diametrically enlarged smooth counter bore 28 which opens outwardly of the end 22 of the body 12 and the body 12 also includes a threaded radial set screw bore 30 formed therein opening outwardly through the side 18 adjacent the end 24, the inner end of the bore 30 opening into the threaded bore 26.

In addition, the side 20 of the body 12 is relieved as at 30 to define a flat inclined mounting surface 32 and the relieved area 30 opens slightly into the counter bore 28. A cutting blade 34 having a pair of laterally outwardly opening notches 36 formed in one longitudinal marginal edge is mounted on the mounting surface 32 through the utilization of a pair of threaded fasteners 38 received through the notches 36 and the edge of the cutting blade 34 opposite the notches 36 is beveled as at 40 and projects slightly into the counter bore 28 along a short chord plane thereof. Thus, the cutting edge defined by the beveled edge 40 has one end thereof projecting slightly into the counter bore 28.

An abutment screw 42 is threaded into the bore 26 and includes an inner abutment defining end 44 which projects at least slightly into the counter bore 28. The end of the abutment screw 42 remote from the counter bore 28 projects slightly outwardly of the remote end of the threaded bore 26 and has a diametric kerf 46 formed therein by which a thin coin 48 may be engaged with the screw 42 in order to impart rotational torque thereto. Also, a set screw 50 is threaded into the bore 30 and includes an inner end which bears against the threads of the abutment screw 42. The outer end of the set screw 50 is equipped with a hexagonal outwardly opening recess 52 by which an allen wrench 52 may be engaged with the set screw 50 for imparting rotary torque thereto With attention now invited now more specifically to FIG. 4 of the drawings, the tip end portion of a cue stick is referred to by the reference numeral 54 and includes a ferrule 56 thereon having a cylindrical outer surface co-extensive with the adjacent cylindrical outer surface of the cue stick. A newly installed tip 58 has been mounted upon the outer end of the ferrule 56 and includes an outer periphery which projects outwardly beyond the cylindrical outer surfaces of the ferrule 56.

In order to trim the outer periphery of the tip 58 to be substantially cylindrical and co-extensive with the cylindrical outer surfaces of the ferrule 56, the tip supporting end of the cue stick is telescoped into the counter bore 28 and after the set screw 50 has been backed out the abutment screw 42 is adjusted so that only the tip 58 projects into the counter bore 28, see FIG. 2. Then the set screw 50 is tightened and the cue stick may be rotated in the direction of the arrow 60, see FIG. 1, relative to the trimmer 10 while the beveled cutting edge 40 of the cutting blade 34 is held against the enlarged outer periphery of the tip 58. Continued rotation of the tip end of the cue stick relative to the trimmer 10 will quickly trim sufficient outer peripheral portions of the tip 58 from the latter so that the outer periphery of the tip 58 is substantially cylindrical and co-extensive with the cylindrical outer surfaces of the ferrule 56, see FIG. 5.

If, on the other hand, a used tip such as that indicated by the reference numeral 62 is disposed on the cue stick tip end, the trimmer 10 may be utilized to trim the outer periphery of the used tip 60 in substantially the same manner in which the tip 58 was trimmed to the configuration thereof illustrated in FIG. 5.

The abutment screw 42 may be adjusted so that only the outer cylindrical portions of the tips 58 and 60 may be engaged by the beveled cutting edge 40 of the cutting blade 34. This will prevent the outer surfaces of the ferrule closely adjacent the tips 58 and 60 from also being trimmed. Of course, the beveled cutting edge 40 parallels the longitudinal center lines of the bore 26 and counter bore 28. Accordingly, the trimming action of the cutting blade 34 on the tips 58 and 60 results in the outer surfaces of the tips 58 and 60 being substantially cylindrical, although a slight cocking of the body 12 relative to the associated cue stick will allow a slight taper to be applied to the outer peripheral surface of the tip being trimmed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cue tip trimmer for trimming the outer periphery of the tip of a cue stick to a generally cylindrical contour substantially co-extensive with the cylindrical outer surface of the cue stick ferrule upon which said tip is mounted, said trimmer including a support body defining an end wise outwardly opening bore for loosely and rotatably receiving a cue stick ferrule mounted cue tip therein, said support body mounting a trimming blade therefrom having a single substantially straight and sharpened edge portion, only, projecting slightly into said bore along a short chord plane thereof, abutment means carried by said body defining an inner limit of movement of said tip into said bore and supported from said body for adjustable shifting relative thereto along said bore, said bore comprising a smooth outer generally cylindrical counter bore portion of a threaded bore formed through said support body and said abutment means comprising a threaded abutment member threaded in said bore and projecting into the inner end of said counter bore.

2. The tip trimmer of claim 1 wherein said support body and trimming blade include co-acting means removably mounting said blade from said support body.

3. The tip trimmer of claim 2 wherein said co-acting means includes means operative to adjustably position said blade along said chord plane to increase the extent the sharpened edge portion of said blade projects into said bore.

4. The tip trimmer of claim 1 including means operative to releasably retain said threaded abutment member in adjusted threaded position within said bore.

5. A cue tip trimmer for trimming the outer periphery of the tip of a cue stick to a generally cylindrical contour substantially co-extensive with the cylindrical outer surface of the cue stick ferrule upon which said tip is mounted, said trimmer including a support body defining an end wise outwardly opening bore for loosely and rotatably receiving a cue stick ferrule mounted cue tip therein, said support body mounting a trimming blade therefrom having a single substantially straight and sharpened edge portion, only, projecting slightly into said bore along a short chord plane thereof, abutment means carried by said body defining an inner limit of movement of said tip into said bore and supported from said body for adjustable shifting relative thereto along said bore, said support body and trimming blade including co-acting means removably mounting said blade from said support body, said co-acting means including means operative to adjustably position said blade along said chord plane to increase the extent the sharpened edge portion of said blade projects into said bore, said co-acting means also including means operative to adjustably angularly displace said sharpened edge portion in said chord plane relative to the longitudinal center line of said bore, said bore comprising a smooth outer generally cylindrical counter bore portion of a threaded bore formed through said support body and said abutment means comprising a threaded abutment member threaded in said bore and projecting into the inner end of said counter bore.

* * * * *